US005375998A

United States Patent [19]

Witteveen

[11] Patent Number: 5,375,998

[45] Date of Patent: Dec. 27, 1994

[54] LOW NOX PREMIX GAS BURNER

[76] Inventor: Gustaaf J. Witteveen, Stationsstraat 41, 6584 As Molenhoek, Netherlands

[21] Appl. No.: 81,292

[22] PCT Filed: Nov. 13, 1992

[86] PCT No.: PCT/NL92/00205

§ 371 Date: Jun. 28, 1993

§ 102(e) Date: Jun. 28, 1993

[87] PCT Pub. No.: WO93/10399

PCT Pub. Date: May 27, 1993

[30] Foreign Application Priority Data

Nov. 14, 1991 [NL] Netherlands ..... 9101896

[51] Int. Cl.[5] ..... F23D 14/12

[52] U.S. Cl. ..... 431/328

[58] Field of Search ..... 431/328, 329

[56] References Cited

U.S. PATENT DOCUMENTS

| | | | |
|---|---|---|---|
| 1,325,782 | 12/1919 | Gault | 431/328 |
| 2,533,104 | 12/1950 | Golden et al. | 431/328 |
| 2,980,104 | 4/1961 | Patrick et al. | 431/328 |
| 3,182,712 | 5/1965 | Zink et al. | 431/328 |
| 3,254,695 | 6/1966 | Brodlin | 431/328 |
| 3,527,199 | 9/1970 | Perry et al. | 431/328 |
| 3,715,183 | 2/1973 | Manifold | 431/328 |
| 3,947,233 | 3/1976 | Sundberg . | |
| 4,557,220 | 12/1985 | Jannemann et al. . | |
| 4,976,609 | 12/1990 | Grob et al. | 431/328 |
| 5,057,007 | 10/1991 | Andringa et al. . | |
| 5,139,416 | 8/1992 | Wagner et al. | 431/354 |

FOREIGN PATENT DOCUMENTS

| | | | |
|---|---|---|---|
| 0092838 | 11/1983 | European Pat. Off. . | |
| 0314897 | 4/1989 | European Pat. Off. . | |
| 0377233 | 7/1990 | European Pat. Off. . | |
| 0415008 | 3/1991 | European Pat. Off. . | |
| 1529164 | 12/1969 | Germany . | |
| 3033988 | 3/1982 | Germany . | |
| 8914576.3 | 3/1990 | Germany . | |
| 521090 | 3/1955 | Italy | 431/328 |
| 564387 | 1/1957 | Italy | 431/328 |
| 431335 | 7/1935 | United Kingdom . | |
| 2240842 | 8/1991 | United Kingdom . | |

OTHER PUBLICATIONS

Patent Abstracts of Japan, vol. 12, No. 346, Sep. 16, 1988 & JP A 63 105 306, May 10, 1988.

Patent Abstracts of Japan, vol. 7, No. 157, Jul. 9, 1983 & JP A 58 062 416, Apr. 13, 1983.

*Primary Examiner*—Carroll B. Dority

*Attorney, Agent, or Firm*—Larson and Taylor

[57] ABSTRACT

A premix gas burner for stoichiometric or lean mixtures of fuel gas has a mixing device and a pervious body adjacent to the mixing device. The pervious body is a flat burner plate or tube of a good heat conducting material and of sufficient thickness that the mixture is heated when passing through openings in the pervious body. The openings are preferably slits spaced from each other over at least four times the slit width, and the thickness of the metal plate or wall of the tube is preferably 2–5 mm.

11 Claims, 3 Drawing Sheets 1000
100
10
1
$NO_x$, CO ppm
0
1
2
3
4
5
6
7
8
$O_2$%
a
b
c

LOW NOX PREMIX GAS BURNER

The invention relates to a premix gas burner with a predetermined regulation range, provided with an air feed and a gas feed, a mixing device for forming from gas and air a mixture, which may be under stoichiometric, stoichiometric or over stoichiometric and a gas pervious body with a feed side, openings to let pass the mixture and a flame side, the body having a sufficient overall heat conductivity to transfer heat to the mixture flowing through its openings in order to maintain the feed side of said body at a sufficient low temperature to prevent back firing.

Such a premix gas burner has been described in U.S. Pat. No. 3 947 233. This known burner has a gas pervious body in the shape of a burner plate of porous metal, preferably a sintered body of metal particles. The pressure of the mixture fed to the burner plate is called stated to be fairly high. The high exit velocity of the mixture causes the flame to be "free burning", which means that the flame does not contact the plate. The exit direction of the mixture is said to be random. This causes turbulence, which enhances mixing and leads to a flame which is short and stable.

This known burner has, however, some disadvantages, which the invention aims to eliminate or at least to reduce.

The first of these disadvantages is, that a plate of sintered particles is rather expensive.

The second is, that it is very difficult to manufacture a sintered plate which is so homogeneous, that nowhere a small gas stream occurs with a relatively low velocity.

The third is, that the overall heat conductivity of a body consisting of sintered particles is considerably reduced in comparison with that of a body of a solid metal. Consequently any slowly moving stream which burns in direct contact with the plate causes a hot spot. Because of the low neat conductivity of the sintered material, such a hot spot will not only be stable, but also may reach a temperature which is so high, that the metal locally is burned. This may lead to growth of the hot spot.

The fourth disadvantage is, that, due to the low heat conductivity, a hot spot will transmit only little heat to its surroundings, so that the location below it at the feed side of the pervious body may become a hot spot too, causing important temperature differences at said feed side.

A fifth disadvantage is, that high velocities of the burning mixture will lead to a flame, which is completely separated from the burner plate and due to good mixing is very hot, without loosing much heat, such as by radiation of the plate or an incomplete burned yellow flame, so that NOx forming may be considerable.

The invention aims to provide a burner of the indicated type, which eliminates or reduces the above indicated disadvantages.

Accordingly the invention provides that the pervious body is of massive solid material and that the openings are manufactured with a well defined cross-sectional shape run regularly from the feed side to the flame side, the heat conductivity of the body material and the pattern of openings being such, that even with the highest body temperatures occurring within said range the highest temperature at the feed side will be below 500° C.

Because with the invention, due to the high cooling of the pervious body, very low flames are allowable, whereas the blow-off point of the flame is almost the same as with the known burners, a very large regulation range or region is possible. This range may go down to 20 Kcal/cm$^2$hr. With the known construction it is thought that difficulties will occur below 100 Kcal/cm$^2$hr.

It is remarked that with the invention the openings running regularly between both sides of the pervious body may have a constant cross-sectional shape and may be directed perpendicularly to the surfaces of the pervious body, but that some deviation, for instance tapered holes or bevelled slits are also possible. The pattern of the openings should be such that sufficient heat transfer from the flame side of the body toward the walls of the openings is present to give off sufficient heat to the gas mixture streaming through said openings. In this respect a greater number of smaller openings, which are nearer to each other will give a better heat transfer to the mixture. Increasing the thickness of the pervious body may give the same result.

A preferred embodiment of the invention provides that the pervious body has such a thickness that with the lowest flame within said region the mixture is submitted to a temperature increase of 60°–200° C. With a temperature increase of the mixture which is lower than 60° C. generally a lower lowest flame is allowable, whereas with an increase of more than 200° C. the burner should be carefully checked whether the lowest flame should not be shifted to a somewhat higher value.

According to a further preferred embodiment it is provided that the heat conductivity of the pervious body, due to its thickness and the pattern of openings is such that with any flame within the said region the temperature difference between two locations of said body never is higher than 150° C. This condition, which rather easily can be checked, may be used when determining the regulation range of an inventive burner.

An important preferred embodiment of the invention provides that the pervious body is made of metal and that the openings each have an invariable or continuously varying cross-section. In this respect it is pointed to the fact, that openings in metal sheets often are stamped, but that with the invention the thickness of the sheet may be greater than the width or diameter of the openings, which condition makes stamping impossible. In that instance holes may be drilled and slits may be sawed, lasered or left out between partial pervious bodies laid beside each other.

The surface area of the cross-sections of the openings in most instances is between 1 and 25% of the surface of the flame side of the pervious body.

With the invention in many cases the heat conductivity coefficient in W/m° C. (watts/meter degree centigrade) of the material of the pervious body is greater than the diameter of an opening or twice the width of an oblong slit in mm, divided by 2.5.

This shows in practice the difference between the invention and known plate burners, as mentioned as state of the art in the cited U.S. Pat. No. 3,947,233.

The thickness of the pervious body according to the invention is mostly greater than 1 mm and often more than 2 mm, a thickness up to 5 mm or even more being useful, especially for burners with a large regulation range.

Because most of the heat transfer occurs in the openings, a thicker pervious body will lead to a lower temperature, other conditions equal.

Without making the pervious body too thick a greater heat transfer to the mixture may also be obtained by providing that one or more auxiliary pervious bodies are added to the pervious body, which auxiliary pervious bodies are passed-through by the mixture and in good heat conduction relation with the pervious body.

Experiments with the invention have shown that the nitrogen oxide generation is favourable and mostly less than half of that of other existing low NOx burners. In this respect it is pointed out, that data about nitrogen oxide generation mostly are based on presumed intermittent use, which gives lower values because a burner forms less nitrogen oxides when only shortly burning. With comparable durations of burnings and with high air excess the invention gives about a quarter of the nitrogen oxide production in comparison with a burner with an isolated layer of metal fibres (mentioned as state of the art in U.S. Pat. No. 3,947,233); and with low air excess even less than one tenth.

Another undesirable by-product of gas combustion is CO. If CO is burned incompletely the heat yield is somewhat decreased, but it is more important that CO-emission is undesirable from an environmental viewpoint.

It has appeared, that with this type of burners in general and consequently also with burners according to the invention the CO production increases considerably with high air excesses. This seems contrary to the opinion that a higher air excess will lead to a more complete burning of CO. That this is not true can possibly be attributed to fact that with high oxygen excess combustion goes so fast that no time is available for post-combustion of CO.

With burners according to the invention and possibly also with other burners of the state of the art a very considerable decrease of CO production can be obtained providing that along the edge of the pervious body a vertical shielding wall is present.

It is meant that the significant lowering of the CO content obtained with this feature (for instance from 70 ppm to about 7 ppm) is to be attributed to the fact that a disturbance of the flame, especially in an edge region of it may induce a local irregularity and probably cooling by reason of which post-combustion of CO does not occur or happens only imperfectly. Of course such a shielding wall is not necessary, if a wall of a flame room or the boiler in which the burner is used fulfils the duty of the shielding wall. If a shielding wall is mounted it is to be preferred that the lower side of the shielding wall adjoins the burner surface immediately or at a small distance in the order of mm or less, whereas its upper side reaches to the height where the combustion reaction has been completed.

The generally very favourable results obtained with the invention are possibly enhanced by very good mixing of fuel gas with combustion air. Accordingly a further aspect of the invention provides that the mixing device contains means to create a rotating air stream moving in the direction of its rotational axis, to which a gas is fed, a stream narrowing down means being located down stream of that rotation creating means and following said narrowing down means an abrupt diameter enlargement.

The pervious body may be a plane or curved plate or a socket or tube, which may be used in horizontal, tilting or vertical position. The latter position may facilitate adaption to the burner room in an existing boiler.

In the following the invention will be further elucidated on hand of the drawing, in which FIG. 1 shows a cross-section through a first embodiment of the invention;

Figure 1:
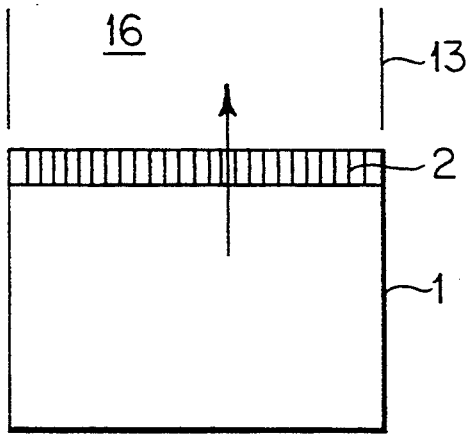

In FIG. 1 reference 1 indicates a room or chamber containing a mixture of gas and combustion air. This room at its upper side is closed by a pervious body 2, which consists of a solid material with straight perforations. If the gas mixture, which has penetrated through the body 2 is ignited an equable low blue flame is formed. This flame heats the upper side of plate 2, but because this consists of a good heat conductor, warmth is fed away downward and to a considerable extend transferred to the mixture of gas and combustion air flowing through it.

The lower side of the plate contacts a mixture of gas and combustion air, but also gives off some heat.

Figure 2:
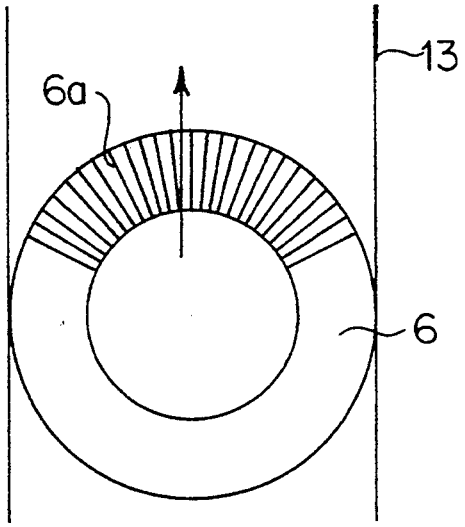
FIG. 2 shows a cross-section through a second embodiment.

FIG. 2 shows an embodiment in which the pervious body is tubular, wherewith the mixture of gas and combustion air passes through the upper half of the tube. The tube is made of massive material in the upper half of which perforations 6*a* have been made.

Figure 3:
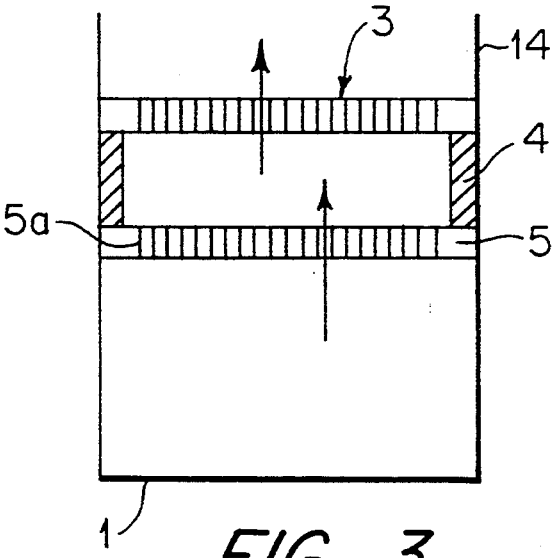
FIG. 3 shows a cross-section through a further embodiment.

FIG. 3 is an example which corresponds mainly to that of FIG. 1. The only difference is that the pervious body with perforations 3*a* in the shape of a plate now has an additional plate shaped auxiliary pervious body 5 mounted therebelow which has perforations 5*a*. Plates 3 and 5 are connected to each other by means of a frame of a heat conducting material. Thus, a certain heating occurs of the gas-combustion air mixture flowing from chamber or space 1 through plate 5.

Figure 4:
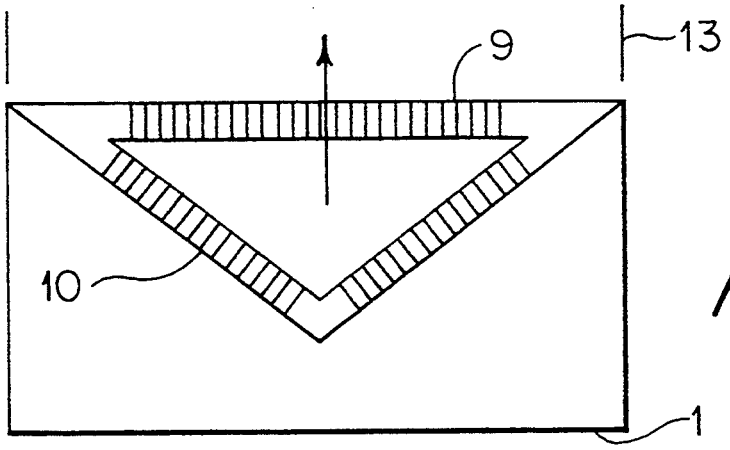
FIG. 4 shows a cross-section through still a further embodiment.

Another embodiment has been shown in FIG. 4. The body consists here in an upper plate 9 and two obliquely downward directed partial plates 10 forming together an auxiliary pervious body. The mixture of gas and combustion air goes [rom space 1 firstly through partial plates 10 and subsequently through plate 9. The heat conduction towards the partial plates 10 occurs via the edges of plate 9. The bulges at the lower side of plate 9 may be prismatic or pyramidal for instance.

Figure 5:
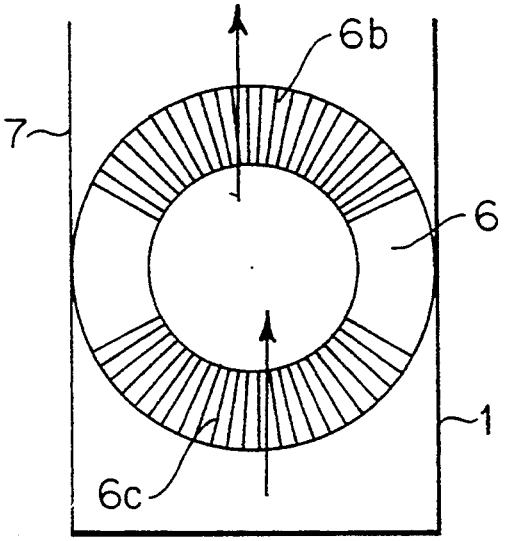
FIG. 5 shows a cross-section through still another embodiment.

FIG. 5 shows an embodiment in which a mixture of gas and combustion air passes the lower side 6*c* from the feed side 1 to reach the inside of this tube. From there it passes the upper part 6*b* of this tube above which it is immediately ignited. Thus, the upper side 6*b* of the tube 6 is heated and by means of heat conductance also the lower part 6*c* receives heat. The mixture firstly flows through the tube towards its inner side and consequently is heated somewhat and when it leaves the inner side of the tube a further heating occurs.

Figure 6:
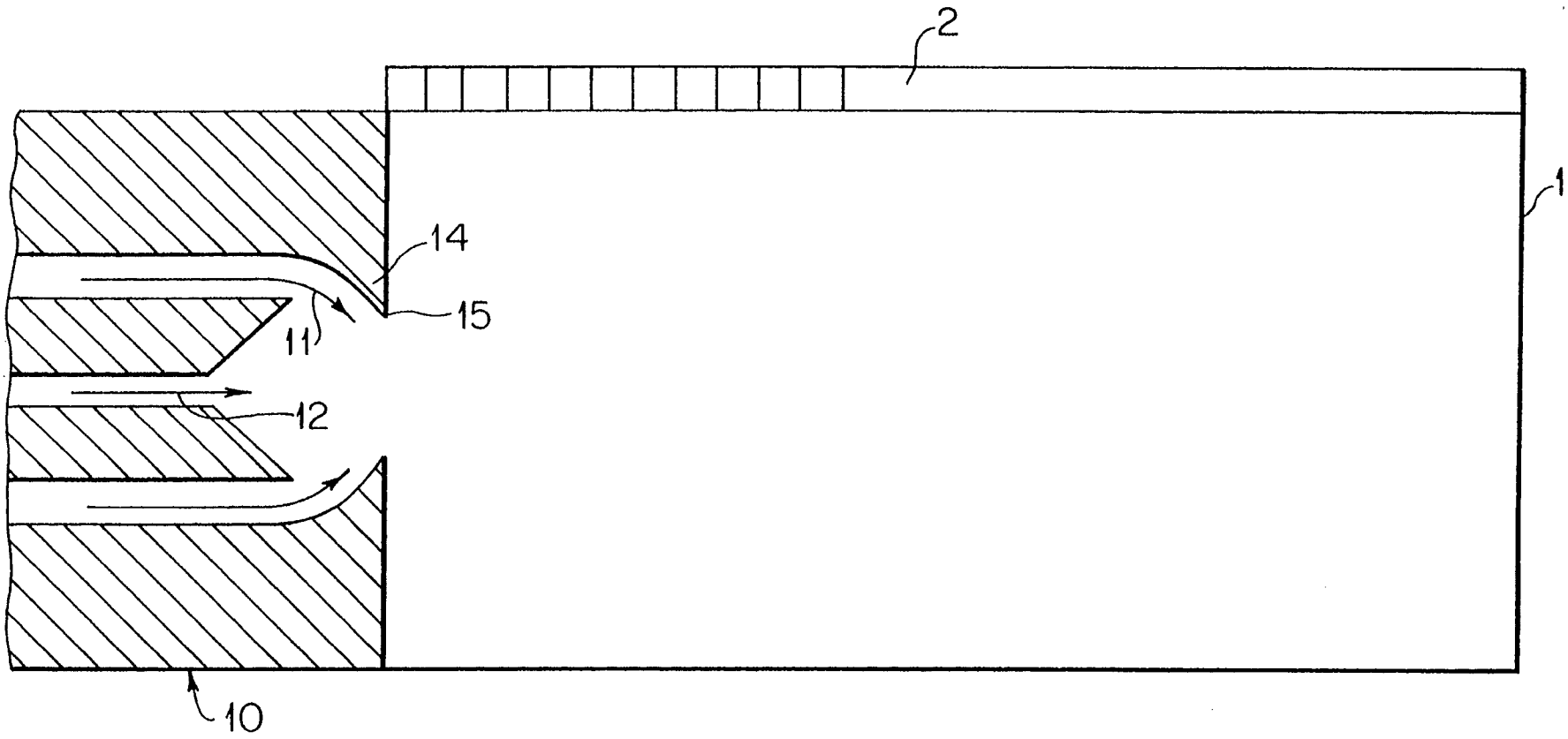
FIG. 6 shows a cross-section through an embodiment, in which a preferred form of the mixing device has been shown.

In FIG. 6 a schematic cross-section has been shown through a burner with a preferred embodiment of the mixing device 10 used therewith. This has an air feed 11, in which air is made to rotate about the axis of this device and a gas feed 12. The air is forced inwardly by means of a narrowing down of the flow 14, by reason of which the rotation becomes very fast and after that a very fast expansion occurs at 15, causing a so-called vortex break down which is accompanied with an excessive intensive mixing. Such a mixer has more specifically been described in the Dutch patent application no.9100490 in the name of applicant and the corresponding PCT/NL92/00055 application.

In FIGS. 1, 2 and 4 a shielding wall 13 has been indicated; which is located at only a small height above the plate 2 or 9 or at a short distance from tube 6. It has appeared, that such a wall reduces to a considerable extend the CO content in exhaust gases with a high oxygen content, possibly even with a factor 10 or, more. The activity of this shielding wall is probably, that irregularities at the edge of the flame are prevented. Possibly these irregularities which may disturb post-combustion of CO or interrupt it, form an important source of CO production, also or even especially in mixtures with a relatively high oxygen excess.

In the following an example of the invention is further discussed.

EXAMPLE

A burner for natural gas is made out of a rectangular tubular profile. The wall thickness of it is 2 mm and the heat conductance coefficient about 50 W/m ° C.

At the upper side of the profile grooves have been made with a width of about 1 mm and a mutual distance of 5 mm. The burner surface is 100 $cm^2$ and the heat capacity with full flame is more than 100 $W/cm^2$.

For the flame velocity of natural gas between 200° K and 700° K approximately the relation $V_{flame}=0{,}0044$ (T(K)-200) m/s is valid. This means that at 300° K the flame velocity $v_{flame}$ is 0.4 m/s. In the slits a velocity is assumed of 1.5 m/s, by reason of which the velocity immediately above the burner surface is 0.3 m/s. This is less than the flame velocity so that the flame will be stabilized.

A natural gas-combustion air mixture becomes about 2000° C. hotter with complete combustion and this value is also obtained with a relatively small air excess. The greater vertical velocity which occurs therewith comes only to existence after the combustion and cannot cause blow-off of the flame.

By warming up of the gas-combustion air mixture in the slits, the flow velocity of the mixture will increase in proportion to the absolute temperature.

Also the flame velocity rises in the considered temperature range (300°-700° K) in proportion to the absolute temperature. The preheating of the gas-combustion air mixture consequently gives an increase of the velocity of this mixture which equals the increase of the flame velocity, so that the one cancels the other. The flow in the slits is clearly laminar (Re, that is to say Reynolds' number, is about 150). This means that the heat transfer is independent from the velocity.

With full flame the measured heat fed to the burner plate is about 4 $W/cm^3$ thus 4%.

The proportion of the combustion heat, which is transferred to the burner surface of the pervious body is smaller with a higher flow velocity of the mixture. Because the flame radiates little, heat transfer mainly occurs by convection. Convection of hot gases from the flame towards the burner surface has to come from greater heights and must overcome a faster flow with higher flow velocities. The dimensions of the micro turbulencies, which mainly cause the heat transfer, in first instance are determined by the pattern of the openings to let the mixture through. If now the very hot gasses come to existence at a distance from the burner surface, which is greater than the dimensions of the turbulencies, the heat transfer to the burner surface is relatively small. This phenomenon is used with known burners without regulation.

With lowering the quantity of heat given off by the flame per unit of time, that is to say regulation, the flow velocity of the mixture is smaller and the hot and very hot gasses come from existence at a smaller distance to the burner surface. This means with a same turbulence pattern a higher heat transfer unto the burner surface per quantity developed heat.

It is assumed, that of the 4% of heat fed to the burner plate about 0.5% is again radiated off. The heat emission by means of radiation is not only strongly dependent on the temperature of the burner plate, but also on the temperature of the surfaces of the space, for example a boiler or furnace space, in which the burner is located. Because it concerns a relatively small value the above estimation is allowable.

Then the gas-air mixture has to take in $4-0.5=3.5\%$ of the generated heat at the temperature equilibrium. That is to say 3.5% of the total temperature increase by combustion, also $0.035\times2000=70°$ C.

Measured was a temperature of the burner plate of about 375° C., which means an average temperature difference with the mixture of $375°-55°=320°$ C. (the air temperature is assumed to be 20° C.).

With lower flame the burner plate temperature will rise by the higher feed back of heat towards that plate, wherewith a higher plate temperature decreases the temperature difference between the flame and the plate and consequently counteracts the increase of the transfer. A higher plate temperature (and colder space in which the plate is located) leads to a greater radiation emission through the plate, which has been related to a smaller quantity of heat generated by the flame.

If now the relative heat transfer of the flame unto the plate is doubled, also 8% and the heat emission by radiation by the higher temperature of the plate and the lower total heat flux gives a twice higher percentage, also 1%, then the mixture has to take in 7% of its own combustion value, that is a temperature increase of 140° C. The average temperature of the mixture in the slits is then 90° C. (with an air temperature of 20° C.).

With a modulation of 50% and equal heat transfer coefficient between plate and mixture the plate temperature $T_p$ is then determined by $T_p-90=0.5$ (375 - 55), from which follows that the plate temperature $T_p$ in the regulated condition is about 250° C.

If with modulation until half the power the relative heat feeding to the burner plate would become four times greater and still 1% of the fed heat would be carried off by radiation, the temperature of the mixture would be increased by $0{,}15\times2000=300°$ C., but the temperature of the burner plate $T_{p1}$ remains 325° C. which follows from $T_{p1}$ - average temperature of the mixture $=1/2.320$.

It follows from the above, that the burner according to the invention allows for a very ample regulation without occurrence of burner plate temperatures. This is in sharp contrast to known burners with isolation of or by the pervious body, wherewith the surface temperature of this body with regulation, at least locally, increases strongly, which increase cannot be compensated in any other way than by heat removal by means of radiation.

From the above follows also, that a burner of normal construction steel of 2 mm and slits of 1 mm width with a mutual distance of 5 mm gives with ample play a sufficient cooled burner plate, also with regulation.

The heat transport of the surface of the burner plate onto the side walls of the openings or slits necessitates a greater temperature difference when the mutual distances between the openings or slits are greater. Then also a larger turbulence pattern occurs with a greater heat flow from the flame towards the burner plate. Consequently with too high burner plate temperatures an improvement can be obtained by a finer pattern of openings or slits. In this respect a thicker plate is also always favourable.

Figure 7:
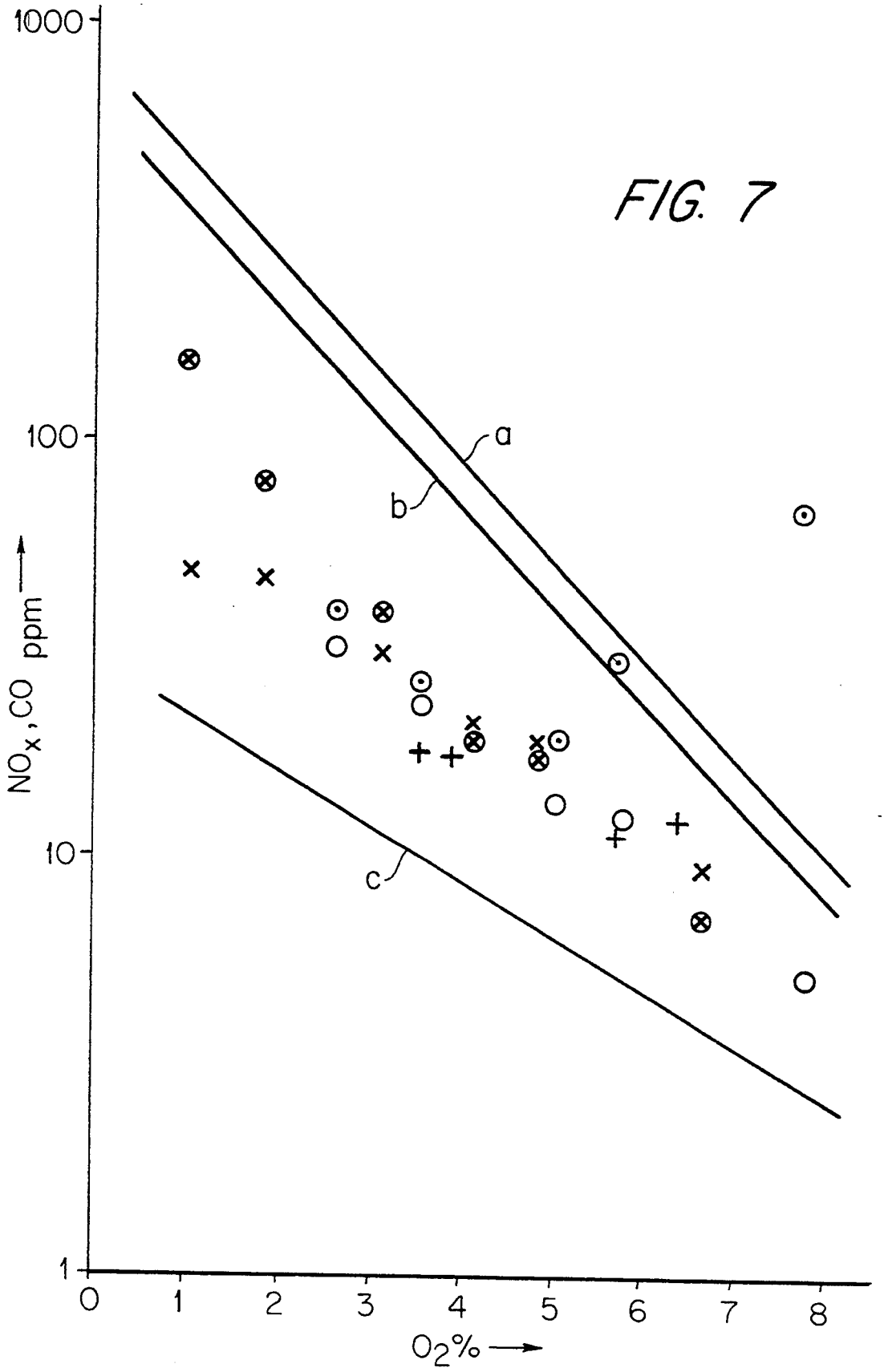
FIG. 7 shows a plot of NOx and CO values of some burners.

In FIG. 7 plots have been shown of different burners. The curve a shows the NOx value of a known burner 1 with an isolation layer of fibres of chromium-iron on the burner surface.

The curve c shows NOx values of a burner according to the Dutch patent application 9100490 (PCT application PCT/NL92/00055) in the name of applicant. Further are:

O the NOx values for a slit burner according to the invention without wall 13;

X the NOx values for a slit burner according to the invention with wall 13;

+the NOx values for a screen burner according to the invention without wall 13;

the CO value for a slit burner according to the invention without wall 13;

the co value for a slit burner according to the invention with wall 13; and b the curve of CO of the known burner 1.

It appears that the invention with respect to the NOx generation forms an important improvement with respect to the known premix burners, but that the NOx values of a burner according to the Dutch patent application 9100490 are still better.

Nevertheless the low NOx values of slit burners are outstanding for such a simple apparatus. A slit pattern with strips between the slits which are at least four times the width of the slits and with non-radiating burner surfaces lower NOx values than can be obtained than with radiating surfaces.

Accordingly a burner having slits with therebetween strips of a width of at least four times the width of the slits forms a preferred embodiment of the invention. A special favourable burner is obtained if the slit width is 0.8 mm or less.

The CO content is with small to moderate oxygen excess lower than with the known burner 1, but with the inventive burner without wall 13 it is higher for a high oxygen excess.

(With this wall 13 the burner according to the invention gives less CO than the known burner 1 over the whole range. This screen burner has a pervious body of closely woven copper gauze of relatively thick wires with a high heating-up of it by a mixture flowing through it by reasons of the good heat conductance of copper and the large heat transfer of a circular wire located transverse to the flow).

Each burner according to the invention can be regulated and consequently can burn with different heat generations. This is contrary to the known burners, as well as the above discussed burner with a thin stainless steel plate with holes.

A further advantage of the invention is, that it has a shape, which can be mounted in many existing central heating boilers in the Netherlands without any difficulty. This means, that in a relatively easy way it is possible to fulfil more severe exigencies with respect to the NOx generation.

In practice a uniform feeding of the mixture to the whole plate often is a problem, if the mixture below the plate has a flow velocity which cannot be neglected. With the embodiment of the invention with two plates, which are passed by the flow the one after the another, this problem is solved.

With the invention it is also possible to cool the pervious body or the plates, for instance with a square frame tube as burner, which is cooled at or near its lower side, for instance with boiler water.

When applying the invention the temperature of the burner plate may increase up to 500° C., wherewith still no back firing below the burner plate has to be feared. In that instance the possibility exists that the mixture of gas and combustion air subdues a heating of the order of 200° C.

An advantage of a relatively hot pervious body is, that dust, which would deposit in the body, is burned so that clogging is prevented.

Because with the invention the temperature always can be controlled and the chance of locally considerable higher temperatures is very small the invention gives an excessive stable burner. Moreover its production price is low, the NOx generation small, whereas the CO generation by means of the shielding wall can be made small and the possibilities of regulation are greater than with known burners with a metallic pervious body.

I claim:

1. A premix gas burner with a predetermined regulation range comprising:

a mixing device for forming a mixture of gas from a gas feed and of air from an air feed, which mixture is stoichiometric or lean; and a gas pervious body formed of a flat plate of solid metal, said pervious body including slits therethrough arranged in a regular pattern and manufactured with a well defined cross-sectional shape from a feed side of said pervious body adjacent said mixing device to a flame side of said pervious body, said pervious body having an overall heat conductivity and pattern of slits such that a transfer of heat to the mixture flowing only through said slits occurs in order to maintain the feed side of said pervious body at a sufficiently low temperature to prevent back firing and to maintain said pervious body at the highest temperature of the regulation range at a temperature of less than 500° C.

said flat plate mating with said mixing device such that all of the gas-air mixture from said mixing device passes through said plate.

2. A premix gas burner as claimed in claim 1 wherein said pervious body is closed except for said slits so that the mixture passes from said feed side to said flame side only through said slits.

3. A premix gas burner as claimed in claim 1 wherein said pervious body includes strips between each adjacent said slit, which said strips have a width at least four times a width of each of said slits.

4. A premix gas burner as claimed in claim 1 wherein said slits have a surface area which is 1–25% of a surface area of said flame side of said pervious body.

5. A premix gas burner as claimed in claim 1 wherein said pervious body has a thickness of more than 1 mm.

6. A premix gas burner as claimed in claim 5 wherein said pervious body has a thickness of 2–5 mm.

7. A premix gas burner as claimed in claim 1 and further including a second pervious body provided between the first-mentioned said pervious body and said mixing chamber in good heat conduction contact with the first-mentioned said pervious body such that the mixture passes through said second pervious body for heat transfer therewith before passing through the first-mentioned said pervious body.

8. A premix gas burner as claimed in claim 7 wherein said second pervious body is parallel to the first-mentioned said pervious body; and further including a frame of a good heat conduction material which mounts said second pervious body relative to the first-mentioned said pervious body.

9. A premix gas burner as claimed in claim 7 wherein said second pervious body comprises two plates connected to the first-mentioned said pervious body and oriented obliquely away from said feed side and toward one another.

10. A premix gas burner as claimed in claim 1 wherein said pervious body includes edges, and further including a vertical shielding wall provided adjacent said edges of said pervious body.

11. A premix gas burner as claimed in claim 10 wherein said shielding wall has a lower side which is immediately adjacent said edges and an upper side which extends above a position at which the combustion reaction of the mixture is completed.

* * * * *